United States Patent [19]

Rude

[11] Patent Number: 4,697,630

[45] Date of Patent: Oct. 6, 1987

[54] TILT MECHANISM FOR VENETIAN BLINDS

[75] Inventor: Edward T. Rude, Fairfield, Conn.

[73] Assignee: General Clutch Corporation, Stamford, Conn.

[21] Appl. No.: 26,963

[22] Filed: Mar. 17, 1987

[51] Int. Cl.[4] ..... E06B 9/26

[52] U.S. Cl. ..... 160/177; 160/176 R

[58] Field of Search ..... 160/166 R, 168 R, 176 R, 160/177 R, 178 R

[56] References Cited

U.S. PATENT DOCUMENTS

| | | | |
|---|---|---|---|
| 3,180,400 | 4/1965 | Rau | 160/176 |
| 3,352,349 | 11/1967 | Hennequin | 160/178 R |
| 4,200,135 | 4/1980 | Hennequin | 160/176 R |

FOREIGN PATENT DOCUMENTS

| | | | |
|---|---|---|---|
| 80696 | 3/1956 | Denmark | 160/176 |
| 300512 | 9/1965 | Netherlands | 160/176 |

*Primary Examiner*—Robert W. Gibson, Jr.

*Attorney, Agent, or Firm*—Gottlieb, Rackman & Reisman

[57] ABSTRACT

A tilt mechanism for monocontrol Venetian blinds uses band brakes to the ends of which the ladder cords are attached. The weight of the blind provides the tightening forces to cause the band brakes to grip the rotating control rod and rotate the slats to open and close the blind. Stops loosen the band brakes allowing further rotation for raising or lowering of the blind to take place with a minimum of torque.

20 Claims, 6 Drawing Figures

TILT MECHANISM FOR VENETIAN BLINDS

The present invention relates to tilt mechanisms for Venetian blinds and, more particularly, to tilt mechanisms for monocontrol Venetian blinds.

Monocontrol Venetian blinds are those in which the raising and lowering function, and the tilt function, are operated by means of a single control. Typically, this control is either a cord which is pulled in one direction or the other, or a rod or crank which is rotated. Moving the control in one direction or the other causes both tilting of the slats and, at a much slower rate, vertical motion. When the slats are fully tilted, continued movement raises or lowers the blind, depending on the direction of movement. In setting the blind, the user brings it to the desired elevation and then moves the control in the reverse direction until the desired angle of tilt is reached.

Such blinds require a system to decouple the tilt mechanism from the lift mechanism so that, after the slats are fully tilted, continued movement of the control can raise or lower the blind. In blinds of the prior art this decoupling has been accomplished in several different ways, all of which make the blind unnecessarily difficult to operate. The problem is that too much frictional force is required to decouple the tilt mechanism from the lift mechanism. During lifting this frictional force is added to the weight of the blind, and both must be overcome by the operator.

The present invention provides a simple tilt mechanism that produces the required amount of torque needed to tilt a blind without producing more frictional drag during lifting than is needed to keep the blind fully tilted. Assembly of the mechanism is easy and no adjustment is needed for blinds of differing weights.

The tilting of Venetian blinds is accomplished by elevating one side of each ladder cord (or tape) with respect to the other side. The blind is fully tilted when one side of each ladder cord is slack. If some of the weight of the blind continues to be supported by the slack sides of the ladder cords, then the blind is not fully tilted. Minimum light leakage is highly desired by users of Venetian blinds, and this occurs only when the blind is fully tilted.

Those Venetian blinds having tilt mechanisms that are operationally separate from their lift mechanisms accomplish the tilting by attaching the ends of the ladder cords to a drum or a short rod in the headrail which can be rotated by the tilt control. Achieving full tilt requires that the entire weight of the blind be supported by the elevated sides of the ladder cords, the other sides being slack. This usually means that, at each end of its travel, the tilt mechanism must lift the blind a small amount. Most separate tilt mechanisms are geared devices that have a large mechanical advantage and operate very slowly so that the required force is easily achieved.

In monocontrol Venetian blinds the situation is quite different, the tilt mechanism being connected to the lift mechanism with some sort of releasing device. At the onset of operation, both tilting and, depending on the direction of operation, raising or lowering occur. All of the tilting occurs during the first small amount of lift system movement so that very little change in elevation will have occurred by the time the blind is fully tilted. Thereafter, continued movement of the operating mechanism produces only a change in elevation, the tilt mechanism remaining in the fully tilted position through slippage between the lift and tilt mechanisms. When the blind is in the fully tilted position, it is still necessary for the tilt mechanism to be capable of supporting the entire hanging weight of the blind. But in this case, the force needed to do this must come from sliding frictional forces between the lift and the tilt mechanisms. The frictional force needed to maintain full tilt is added to the blind's weight and other forces that the user must exert to elevate the blind. Frictional forces are quite variable and, in systems that must be mass produced, it is very difficult to maintain a consistent frictional force between component parts that must slide with respect to one another. Furthermore, the frictional force that is required to fully tilt a Venetian blind depends upon the weight, and so on the size of the blind. Therefore, in any practical, commercial headrail system, sufficient friction must be provided to fully tilt the largest size of blind that is to be operated with that headrail system. The usual method of ensuring that there is sufficient friction available is to provide a large excess so that there will surely be enough even under the worst condition. This added frictional force is quite noticeable and objectionable, and it has been blamed for the lack of popularity of monocontrol Venetian blinds.

U.S. Pat. No. 3,352,349 discloses a frictionally based system for tilting a Venetian blind. The ends of the ladder cords are secured to a "lift cord carrier" which is "mounted in a slightly clamping manner on the operating shaft" thus providing a more or less fixed amount of frictional force to produce tilting. With this system, the large amount of friction that must be provided to insure proper tilting continues to be felt by the operator during lifting.

U.S. Pat. No. 4,200,135 discloses the application of a wrap spring clutch to provide controllable tilting without the need for overcoming the maximum frictional force during lifting. Wrap spring clutches are capable of providing a large, but predetermined amount of torque. When they are released they still require a certain torque to induce slippage. This torque is of a much smaller, but nevertheless, predetermined amount. In this case, the wrap spring clutch provides a predetermined tilting force until the blind is fully tilted, whereupon one end of the wrap spring hits a preset stop, loosening the wrap spring. Thereafter, during continued movement of the lift system in the same direction to either lift or lower the blind, it must maintain at least the torque necessary to keep the blind fully tilted. But the slit torque of the wrap spring must still be overcome and this can mean an excessive force in a small blind. Also disadvantageous is the large number and complexity of component parts that are required to make the system function. In addition to the spring itself, a rotatable element is required to release the spring. The ladder cords are attached to yet another rotatable element, and the headrail must be made larger to accommodate all of these components.

Our invention provides a means for controllably decoupling the tilt mechanism from the lifting mechanism in a monocontrol Venetian blind so that during lifting, only the amount of frictional force needed to maintain full tilt is produced. In this way, force sufficient to reach full tilt is ensured and yet no unnecessary effort is required of the user while the blind is being lifted. The result is that the user's perception of the blind's operation is much more favorable.

The system of our invention is self adjusting. It retains all of the advantages of the wrap spring clutch approach without the attendant complexity, and without the need to overcome a slip force. Briefly, in accordance with the principles of our invention, a band brake rides above each ladder cord on the central rod that operates the blind. One side of each ladder cord is attached to an end of a band brake so that the weight of the blind tends to tighten the band brakes about the central rod. The blind is lifted by rotation of the central rod, the lift cords being wound thereupon or by some other appropriate means. The band brakes rotate together with the central rod until they reach the position in which the slats are fully tilted. Thereafter, the band brakes partially release, providing only the torque necessary to keep the blind fully tilted. During tilting, the tension due ro the supported weight in each ladder cord provides the force needed to tighten its respective band brake about the central rod. When the fully tilted position has been reached, a stop loosens each band brake so that continued rotation of the rod produces no further tilting. This stop never needs adjustment and it can easily be incorporated into the bearing support for the central rod.

There are several striking advantages to this arrangement, the most significant being that this tilt mechanism compensates automatically for weight of the blind since the ladder cords hang directly on the band brakes. The torque from a band brake is a function of the difference between the forces applied at its two ends, increasing exponentially with the angle of wrap. If the coefficient of friction between the band and the rod or tube on which it rotates is 0.11, then the torque from the band brake doubles with each additional 360 degrees of wrap. The preferred embodiment of our invention employs a band brake with one and one-half turns of wrap which provides far more torque than the half turn that is achieved by simply looping the cords over a drum. Still greater torque can be achieved by adding additional turns. In a wrap spring brake, the spring grips the surface on which it rides by means of a preload in the spring. In order to release the wrap spring and cause it to slip, a force is needed just to overcome the preload. This force is added to the force that the operator must apply in raising the blind. In contrast to wrap spring brakes, no preloading of the band brakes is needed. Thus the residual drag due to the preload is eliminated, improving the operation and making the tilting far more reliable. The elimination of a requirement for a preload allows the tilter to be made from plastic material. Plastic is not a suitable material for strings in wrap spring clutches because the high temperatures to which window coverings are exposed would cause creepage in the plastic resulting in the loss of the preload.

As a Venetian blind is tilted from the horizontal orientation and the slats rotate into a more vertical orientation, the two vertical legs of the ladder cords move closer together. Ideally, the tilter, from which the ladder cords hang, should control the ends of the ladder cord to move in the same way. The ideal tilter is a flat bar, of an extent equal to the width of the slats, with the ladder cords attached at its ends. As the tilter rotates, the vertical legs of the ladder cord can move closer together. Many blinds use a cylindrical drum tilter whose diameter is equal to the width of the slats. Achieving full tilt with a drum of this type is more difficult because the ends of the ladder cord remain at the same separation as the drum rotates. Even the use of a flat bar as a tilter on a central rod does not permit the ladder cord ends to move completely together when the tilter is vertical, because the rod on which the tilters are mounted eventually limits the inward movement of the ladder cord that is being raised. For this reason, it is desirable to use a rod of a small diameter. It has been found in practice that the tilter can be rotated slightly over center so that the lowered side of the ladder cord moves very close to the elevated side, thereby permitting full closure of the blind. Some operating systems for Venetian blinds accumulate the lift cords within the headrail by causing them to wrap about the central rod. U.S. Pat. No. 3,352,349 reveals such a system. Systems of this type require that the central rod be larger than is desirable for use in the system of our invention. This difficulty can be overcome by affixing to the central rod, at only those locations requiring a larger diameter, a sleeve that rotates along with it. This permits the rod diameter to be small where the tilters are located.

It is an object of our invention to provide a mechanism for tilting a monocontrol Venetian blind that provides sufficient torque to fully tilt the blind and yet requires no more operating torque during lifting than is necessary to keep the slats fully tilted.

It is another object of our invention to provide a mechanism for tilting a monocontrol Venetian blind that has optimal geometry for tilting.

It is yet another object of our invention to provide a mechanism for tilting a monocontrol Venetian blind that uses a minimum of parts.

It is yet another object of our invention to provide a mechanism for tilting a monocontrol Venetian blind that provides for easy attachment of he ladder cords to the tilt mechanism.

It is yet another object of our invention to provide a single element, to which the ladder cords can be easily attached, that is configured for optimal tilt geometry, and which, during raising of the blind, transmits to the operating mechanism only that amount of torque necessary to maintain full tilt.

Further objects, features and advantages of our invention will become apparent upon consideration of the following detailed description in conjunction with the drawings, in which.

Figure 1:
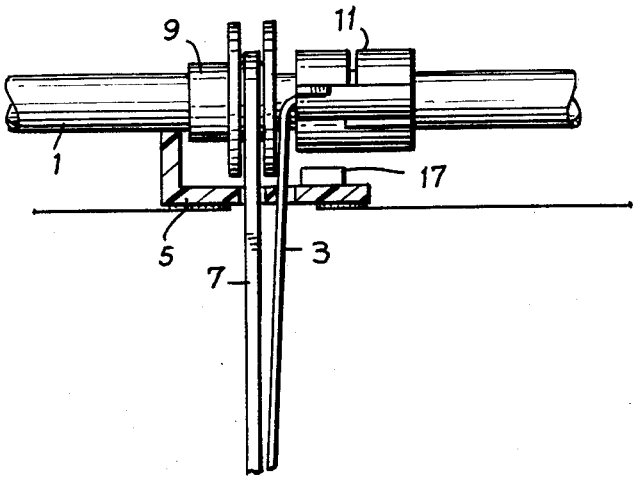
FIG. 1 shows a front elevation of the lift and tilt mechanisms for a monocontrol blind.
Figure 3:
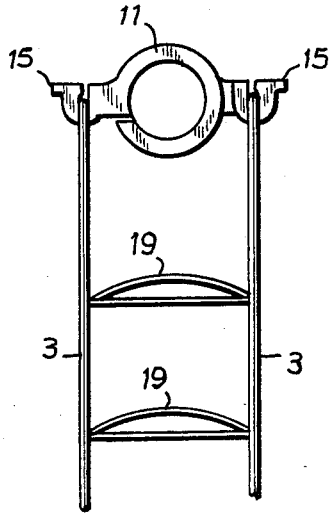
FIG. 3 is a side view showing a tilter and ladder cord with the slats in the open position.
Figure 2:
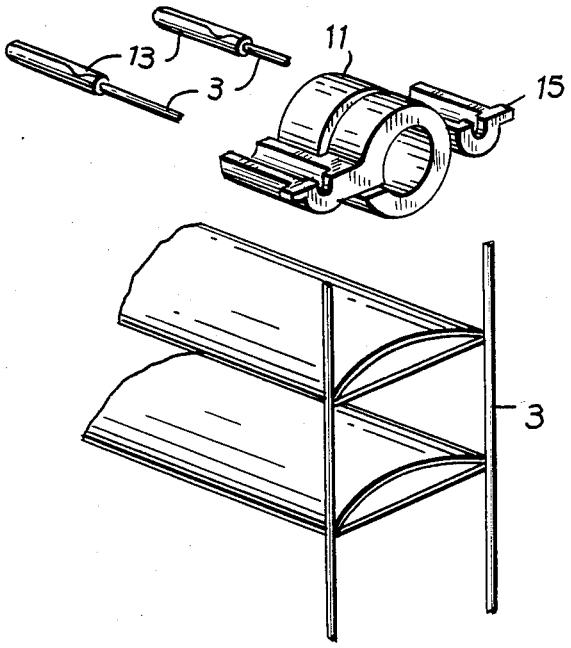
FIG. 2 shows an angled view of the tilter in which its band brake construction can be seen.
Figure 4:
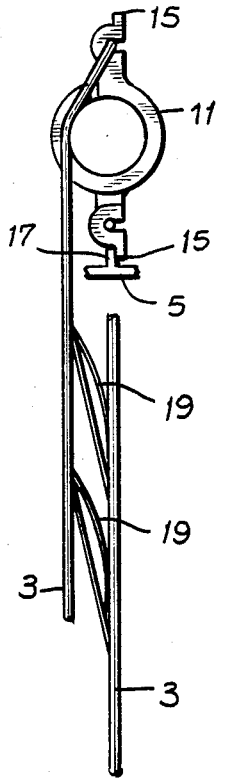
FIG. 4 shows a side view of the tilter, ladder cords, and stop.

The illustrative embodiment of our invention, as shown in FIG. 1, has a central rod 1 supported at the location of each ladder cord 3, of which only one is shown, by a cradle 5. Some suitable means is provided for accumulating lift cord 7 such as spool 9 which is shown here only by example. Spool 9 is fixedly attached to rod 1 to rotate therewith. An end of lift cord 7 is attached to spool 9. Tilter 11 is slidably mounted on rod 1. The upper ends of ladder cords 3 are connected to tilter 11, preferably by means of barbs 13, best seen in FIG. 2, or other suitable means which, having been previously attached to the ladder cords, are then mounted to the tilter. The spiral construction of tilter 11 can be seen in FIG. 2. One side of ladder cord 3 is attached at each end of the spiral in such a way that the weight of the blind hanging on tne ladder cord causes tilter 11 to tighten its grip around rod 1. As shown in FIG. 3, tilter 11 has an ear 15 protruding radially from each of its ends. Continued rotation of rod 1 with tilter 11 mounted thereupon will cause one or the other ear 15 to hit stop 17 on cradle 5 as shown in FIG. 4.

To operate the blind, a positioning device is needed that can provide controllable rotation of rod 1 when required, and maintain the position of rod 1 when operation ceases. U.S. Pat. No. 4,372,432 discloses one such mechanism, but others can be used instead. As the operator moves the positioning device, rod 1 rotates, winding or unwinding lift cord 7 from spool 9 according to the direction of rotation. At first, tilter 11 turns with rod 1. When the slats 19 are open tilter 11 is in the horizontal position as in FIG. 3. With continued rotation tilter 11 will finally reach the fully tilted position, shown for one direction in FIG. 4, in which an ear 15 comes into contact with stop 17. This contact causes tilter 11 to loosen its grip on rod 1 so that continued rotation of rod 1 can occur subject to only that amount of frictional drag between rod 1 and tilter 11 required to maintain contact between ear 15 and stop 17. Under reversed rotation of rod 1, tilter 11 immediately regrips rod 1 and rotates with rod 1 causing the slats 19 to open. Continued rotation will eventually bring the other ear 15 into contact with stop 17. In this position, the slats 19 will be closed in the other direction. Further rotation of rod 1 will reduce the grip of tilter 11 on rod 1 to that amount necessary to maintain contact, again lessening the drag that is imposed on the rotation of the rod.

Figure 6:
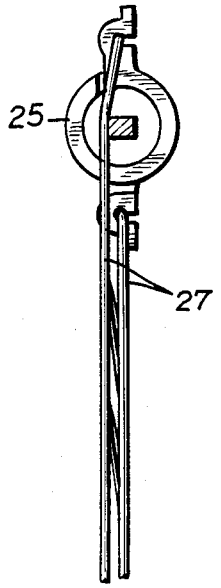
FIG. 6 is a side view of the tilter and rod of FIG. 5, showing the ladder cord in a fully tilted position.
Figure 5:
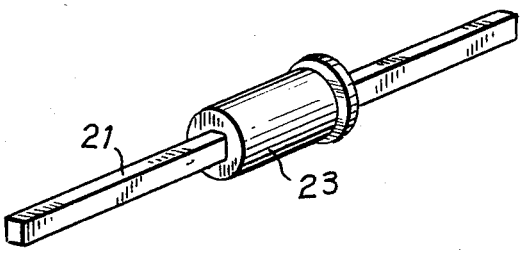
FIG. 5 shows an alternative means for mounting a tilter on the rod.

The geometry of the tilt mechanism can be improved by using the construction shown in FIGS. 5 and 6. Rod 21 is of a small cross-sectional area, chosen to be as small as possible and yet have the strength to transmit the requisite torque. A tilt driver sleeve 23 is mounted about rod 21, to rotate therewith, at the location of each of the ladder cords. The tilter 25 (FIG. 6) is mounted rotatably about sleeve 23 so that the ladder cords fall past the end of sleeve 23. When the blind is fully tilted, as shown in FIG. 6, the ladder cords can come closer together before hitting rod 21. This permits better closure of the blind.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A tilter for a monocontrol Venetian blind comprising a helix adapted for rotatable disposition about a central rod, each end of said helix being configured for attachment to one leg of a ladder cord.

2. A tilter for a monocontrol Venetian blind in accordance with claim 1 wherein said helix is configured to grip said central rod to rotate therewith when the tensions in said ladder cord legs produce a net component of force in a direction that tends to tighten said tilter about said central rod and to slip when said net component of force is absent.

3. A system for controlling the tilt of a monocontrol Venetian blind comprising a helical tilter adapted for rotatable disposition about a central rod, each end of said helical tilter being configured for attachment to one leg of a ladder cord; and a sleeve of a generally cylindrical shape mounted for rotation with said central rod; said helical tilter being configured to grip said sleeve to rotate therewith when the tensions in said ladder cord legs produce a net component of force in a direction that tends to tighten said tilter about said sleeve and to slip when said net component of force is absent.

4. A system for controlling the tilt of a monocontrol Venetian blind in accordance with claim 3 wherein said tilter ends are configured such that said ladder cord legs are positioned beyond the end of said sleeve to provide clearance for said legs to lie closer to the axis of said central rod than the outside radius of said sleeve.

5. A system for controlling the tilt of a monocontrol Venetian blind in accordance with claim 3 further including a stop positioned for loosening the grip of said tilter on said rod at the position corresponding to full tilt for either direction of rotation.

6. A system for controlling the tilt of a monocontrol Venetian blind in accordance with claim 5 in which said stop is positioned to loosen said tilter when said tilter is rotated to at least a vertical orientation.

7. A system for controlling the tilt of a monocontrol Venetian blind in accordance with claim 5 in which said helical tilter has more than one turn disposed around said central rod.

8. A system for controlling the tilt of a monocontrol Venetian blind in accordance with claim 5 in which said tilter is made of plastic material.

9. A system for controlling the tilt of a monocontrol Venetian blind in accordance with claim 3 in which said helical tilter has more than one turn disposed around said central rod.

10. A system for controlling the tilt of a monocontrol Venetian blind in accordance with claim 3 in which said tilter is made of plastic material.

11. A tilt mechanism for a Venetian blind comprising a helical band brake adapted for rotatable disposition about a central rod, each end of said helical band brake being configured for attachment to one leg of a ladder cord which, by the weight of the blind suspended therefrom, provides a downward tensile load to tighten said helical band brake about said central rod to provide frictional driving force therebetween whenever said helical band brake has an angular orientation in which the tensions in both of said ladder cords tend to increase the angle of wrap of said helical band brake about said central rod.

12. A tilt mechanism for a Venetian blind in accordance with claim 11 further including a stop positioned for loosening the grip of said tilter on said rod at the position corresponding to full tilt for either direction of rotation.

13. A tilt mechanism for a Venetian blind in accordance with claim 11 further including a sleeve of a generally cylindrical shape mounted for rotation with said central rod, said helical band brake being configured to grip said sleeve to rotate therewith when the tensions in said ladder cord legs produce a net component of force in a direction that tends to tighten said helical band brake about said sleeve and to slip when said net component of force is absent.

14. A tilt mechanism for a Venetian blind in accordance with claim 13 wherein said band brake ends are configured such that said ladder cord legs are positioned beyond the end of said sleeve to provide clearance for said legs to lie closer to the axis to said central rod than the outside radius of said sleeve.

15. A tilt mechanism for a Venetian blind comprising a central rod and a tilter adapted for rotatable disposition about said central rod, characterized in that said tilter is in the form of a helical band brake having a central portion configured for gripping the central rod and two arms configured for receiving the ends of a pair of ladder cords legs.

16. A tilt mechanism for a venetian blind in accordance with claim 15 wherein each of said ladder cord legs, by the weight of a blind suspended thereby, provides a downward tensile load to tighten said band brake about said central rod to provide frictional driving force therebetween whenever said band brake has an angular orientation in which the tensions in said ladder cord legs tend to increase the angle of wrap of said band brake about said central rod.

17. A tilt mechanism for a Venetian blind in accordance with claim 16 further including a sleeve of a generally cylindrical shape mounted for rotation with said central rod, said helical band brake configured to grip said sleeve to rotate therewith when the tensions in said ladder cord legs produce a net component of force in a direction that tends to tighten said band brake about said sleeve and to slip when said net component of force is absent.

18. A tilt mechanism for a Venetian blind in accordance with claim 17 in which said band brake arms axially position said ladder cord legs beyond the end of said sleeve to provide clearance for said legs to lie closer to the axis of said central rod than the outside radius of said sleeve.

19. A tilt mechanism for a Venetian blind in accordance with claim 18 further incorporating a stop positioned for loosening the grip of said tilter on said rod at the position corresponding to full tilt for either direction of rotation.

20. A tilt mechanism for a Venetian blind in accordance with claim 16 further incorporating a stop positioned for loosening the grip of said tilter on said rod at the position corresponding to full tilt for either direction of rotation.

* * * * *